United States Patent [19]

Oliff

[11] Patent Number: 4,728,025

[45] Date of Patent: Mar. 1, 1988

[54] CARTON HAVING END PANELS AND FOR PACKAGING PRIMARY ARTICLES OF CUBICAL SHAPE

[75] Inventor: James R. Oliff, Austell, Ga.

[73] Assignee: The Mead Corporation, Dayton, Ohio

[21] Appl. No.: 78,405

[22] Filed: Jul. 27, 1987

[51] Int. Cl.[4] ..... B65D 5/08

[52] U.S. Cl. ..... 229/40; 206/427; 229/DIG. 9

[58] Field of Search ..... 229/40, DIG. 9; 206/427, 434

[56] References Cited

U.S. PATENT DOCUMENTS

| | | | |
|---|---|---|---|
| 2,210,443 | 8/1940 | Bergstein | 229/DIG. 9 |
| 2,713,453 | 7/1955 | Williamson | 229/40 |
| 3,156,377 | 11/1964 | Wysocki | 229/40 |
| 4,394,903 | 7/1983 | Bakx | 229/40 |

FOREIGN PATENT DOCUMENTS

| | | | |
|---|---|---|---|
| 2433711 | 1/1975 | Fed. Rep. of Germany | 229/40 |
| 1438561 | 4/1966 | France | 229/40 |
| 299914 | 8/1965 | Netherlands | 206/620 |

*Primary Examiner*—Stephen Marcus
*Assistant Examiner*—Gary E. Elkins
*Attorney, Agent, or Firm*—Rodgers & Rodgers

[57] ABSTRACT

A tubular carton having a top wall foldably joined along its side edges with side walls to the bottom edges of which a bottom wall is joined is provided with an end panel at each end of the carton which is foldably joined to the end edge of the bottom wall and which is maintained in vertical set up position by means of a side panel foldably joined to a side edge of the bottom wall and which is interconnected at each end with a tucker web and to which a tucker panel is foldably connected and which in turn is foldably adjoined to the adjacent end of the end panel at each end of the carton. A tucker flap is foldably joined to each end of a side wall foldably joined to the opposite side edge of the bottom wall together with a tucker panel which is foldably joined to each tucker flap and to the adjacent end edge of the adjacent end panel. The blank is arranged so as to accommodate easy and efficient nesting of one blank with an adjacent reversed blank where a number of side by side blanks are cut from a common sheet of material.

4 Claims, 5 Drawing Figures

CARTON HAVING END PANELS AND FOR PACKAGING PRIMARY ARTICLES OF CUBICAL SHAPE

TECHNICAL FIELD

This invention relates to the packaging of a plurality of primary packages of cubical shape.

BACKGROUND ART

U.S. Pat. No. 4,545,476 issued Oct. 8, 1985 and owned by the assignee of this invention relates to packaging of articles of cubical shape in a secondary package and provides for rotating preselected articles on which the uniform product code is applied along one surface thereof so as to preclude a check out recognition of such surface and thereby to avoid an eroneous indication that only one such item is being purchased whereas in fact a plurality of such items are included within a secondary package. The invention of U.S. Pat. No. 4,545,476 does not contemplate overlying the uniform product code of a primary package with a panel of the secondary package so as to prevent incorrect tabulation of the price of the contents of the secondary package.

U.S. Pat. No. 4,582,199 issued Apr. 15, 1986 discloses a secondary package for packaging a plurality of cubical articles. The arrangement of this patent contemplates a double thickness top wall which utilizes a substantial amount of material and the carton of this patent is formed from a blank which does not lend itself to nesting and for this reason is costly to manufacture.

SUMMARY

According to this invention in one form, a carton is formed from a blank which is adapted for side by side nesting with a reverse identical blank and which includes a top wall, side walls foldably joined to the side edges of the top wall, a bottom wall foldably joined along one side edge thereof to the bottom edge of one side wall, an end panel foldably joined to each end of the bottom wall, a tucker flap foldably joined to each end edge of the side wall to which the bottom wall is foldably joined, a tucker panel foldably joined to an end of each tucker flap along a diagonal fold line and to the adjacent end edge of the adjacent end panel, a side panel foldably joined to the other side edge of the bottom wall, a tucker web foldably joined to each end of the side panel along a diagonal fold line, a tucker panel foldably joined to each tucker web and to the adjacent end edge of the adjacent end panel. The tucker flap and tucker panel manipulate one end of each end panel while the tucker web and tucker panel manipulate the opposite end edge of each end panel during formation of the carton and locking means including at least one locking aperture formed in the bottom wall which receives a locking tab foldably joined to a locking panel foldably joined to the bottom edge of the other side wall.

BEST MODE OF CARRYING OUT THE INVENTION

Figure 1:
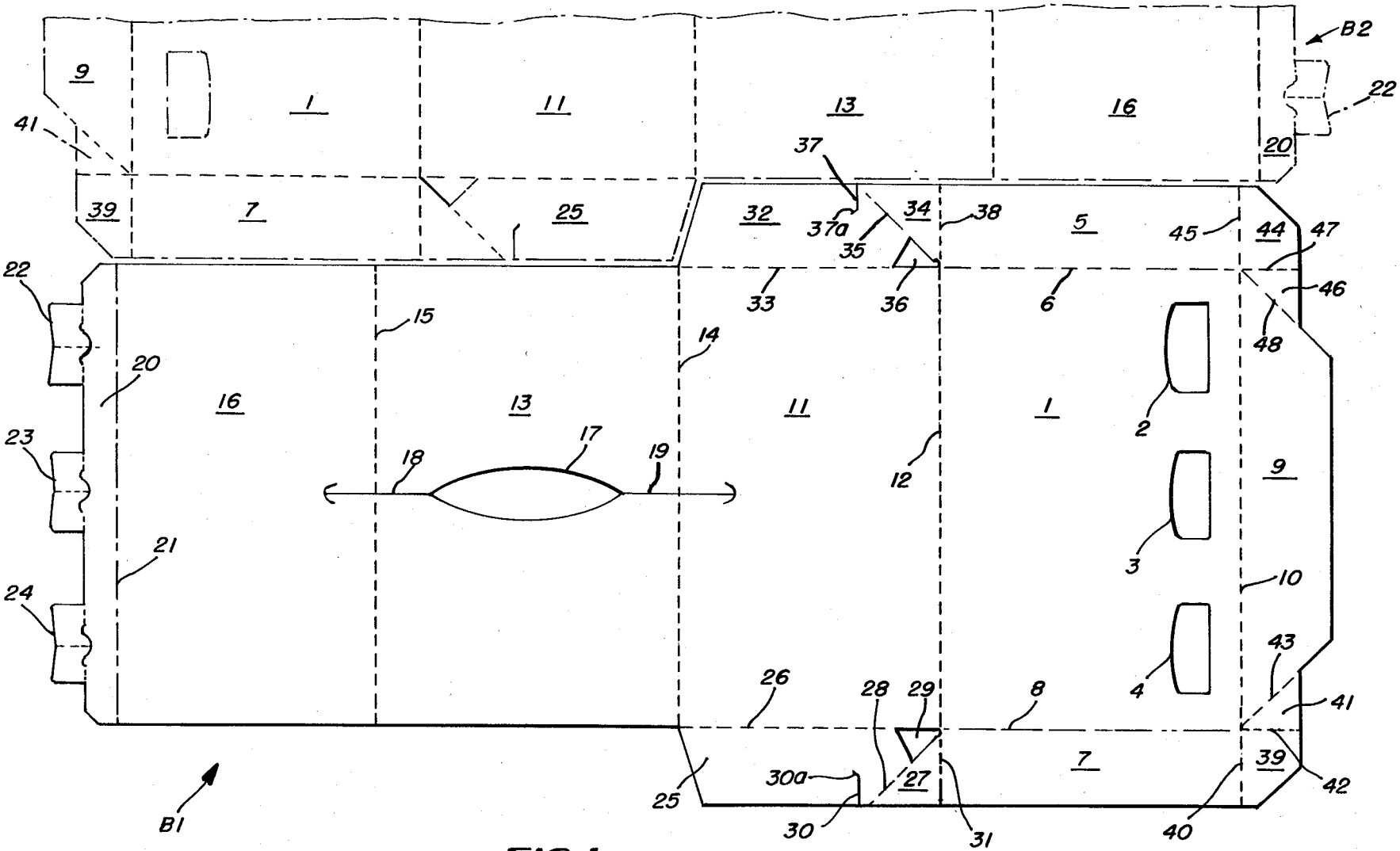
FIG. 1 is a plan view of the inside of a blank from which a carton according to this invention is formed and which represents nesting of one blank with a reversed adjacent blank.

With reference to FIG. 1, the blank B1 is shown in nested relation with a side portion of a complementary blank B2 shown in phantom lines whereby nesting of the blanks is represented.

With reference to FIG. 1, the numeral 1 designates the bottom wall of the blank in which locking apertures 2, 3 and 4 are formed. An end panel 5 is foldably joined along fold line 6 to an end edge of bottom wall 1 while end panel 7 is foldably joined along fold line 8 to the opposite end edge of bottom wall 1. A side panel 9 is foldably joined along a side edge 10 of bottom wall 1 and a side wall 11 is foldably joined along fold line 12 to a side of bottom wall 1. Top wall 13 is foldably joined to the top edge 14 of side wall 11 and is foldably joined along its side edge 15 to side wall 16. A hand gripping aperture 17 is formed in top wall 13 and includes slits 18 and 19 which provide space relief for the user as is well known. A locking panel 20 is foldably joined to the bottom edge 21 of side wall 16 and includes locking tabs 22, 23 and 24 which cooperate respectively with locking apertures 2, 3 and 4 formed in bottom wall 1 as is well known.

For the purpose of manipulating the end panels such as 5 and 7 into set up condition, tucking structure is provided according to this invention which cooperates with each end edge of each end panel. As is best shown in FIG. 1, tucker flap 25 is foldably joined to an end edge of side wall 11 along a fold line 26 and is foldably joined to tucker panel 27 along diagonal fold line 28. A corner of tucker flap 25 is cutaway as indicated by the triangular structure indicated at 29 and a manipulating slit 30 is formed in tucker flap 25. Slit 30 has an angularly disposed end portion 30*a*. Tucker panel 27 is foldably joined to the adjacent end of end panel 7 along a fold line 31.

At the other end of side wall 11 a tucker flap 32 is foldably joined to the end of side wall 11 along fold line 33. Tucker flap 32 is foldably joined to tucker panel 34 along diagonal fold line 35. A triangular shaped corner portion 36 is cutaway from tucker flap 32 and a relieving slit 37 having an angularly disposed end portion 37*a* is formed in tucker flap 32. Tucker panel 34 is foldably joined to the adjacent end of end panel 5 along fold line 38.

At the opposite end of end panels 5 and 7, similar structure is provided. Tucker panel 39 is foldably joined along fold line 40 to the right hand end of end panel 7 and tucker web 41 is foldably joined to tucker panel 39 along fold line 42. Tucker web 41 is foldably joined to side panel 9 along diagonal fold line 43.

In like fashion, tucker panel 44 is foldably joined to the right hand end of end panel 5 along fold line 45 and is foldably joined to tucker web 46 along fold line 47. Tucker web 46 is foldably joined to side panel 9 along a diagonal fold line 48.

Figure 2:
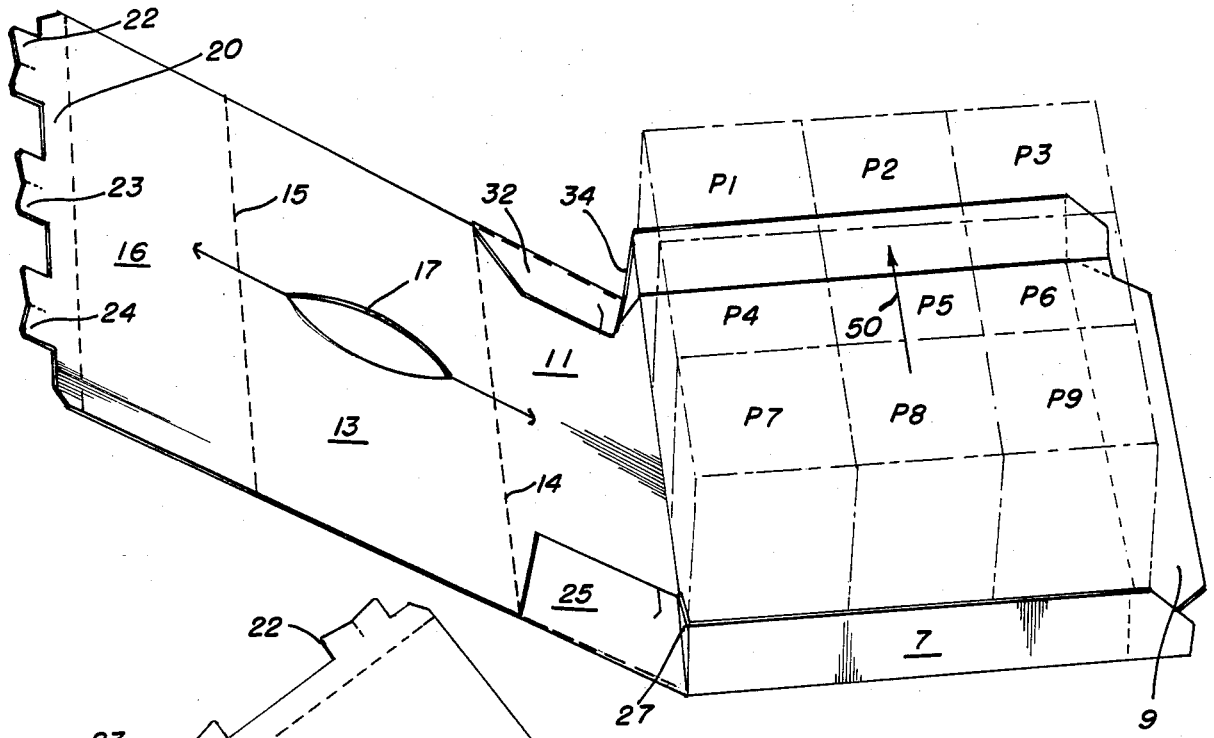
FIG. 2 is a perspective view of the blank shown in FIG. 1 together with cubical packages shown in phantom lines and which represents an initial folding operation employed in the formation of the package.

Blanks such as B1 are fed in sequence underneath a group of primary packages such as P1–P9. Movement of the group as shown in FIG. 2 is in the direction indicated by the arrow 50. The tucker flaps 25 and 32 are folded along fold lines 26 and 33 respectively and are manipulated through 180 degrees from the position represented in FIG. 1 to that represented in FIG. 2. This manipulation is by suitable machine elements and swings the end panels 5 and 7 into vertical upright positions.

Figure 3:
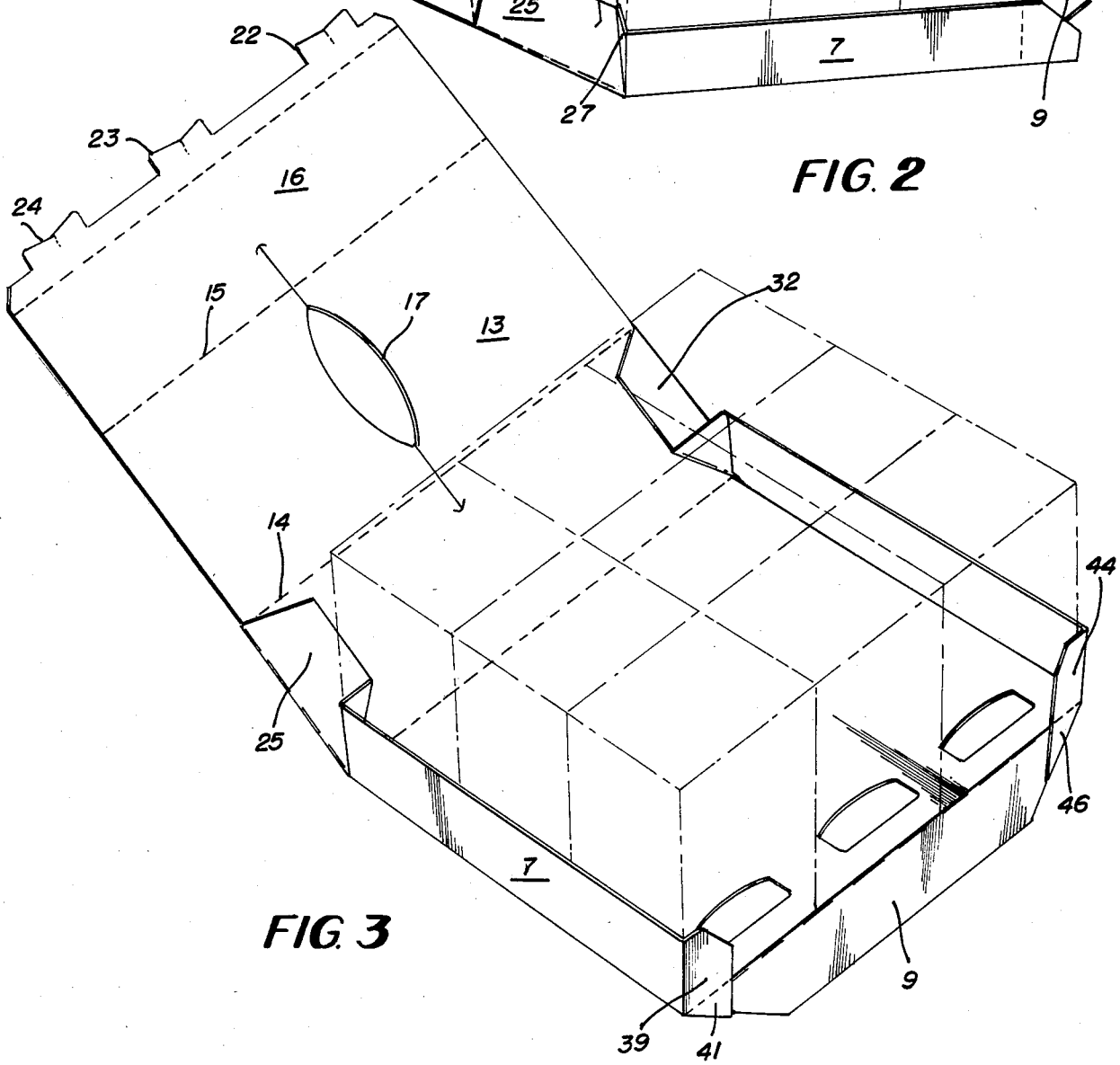
FIG. 3 is a view similar to FIG. 2 and represents a subsequent stage in the formation of the package.

Thereafter the side panel 9 is folded downwardly along fold line 10 into a vertical position as represented in FIG. 3. Side panel 9 is then folded upwardly through 180 degrees to occupy the vertical position represented in FIG. 4. During this operation, the tucker panel 39 is moved into flat face contacting relation with the side of primary package P9 and the tucker web 41 is interposed between side panel 9 and tucker panel 39 and in face contacting relation with side panel 9 and tucker panel 39. Simultaneously tucker panel 44 is manipulated by suitable machine guides into flat face contacting relation with a side wall of primary package P3. Simultaneously tucker web 46 is manipulated into a position intermediate side panel 9 and tucker panel 44 and in face contacting relation with these two elements.

Figure 4:
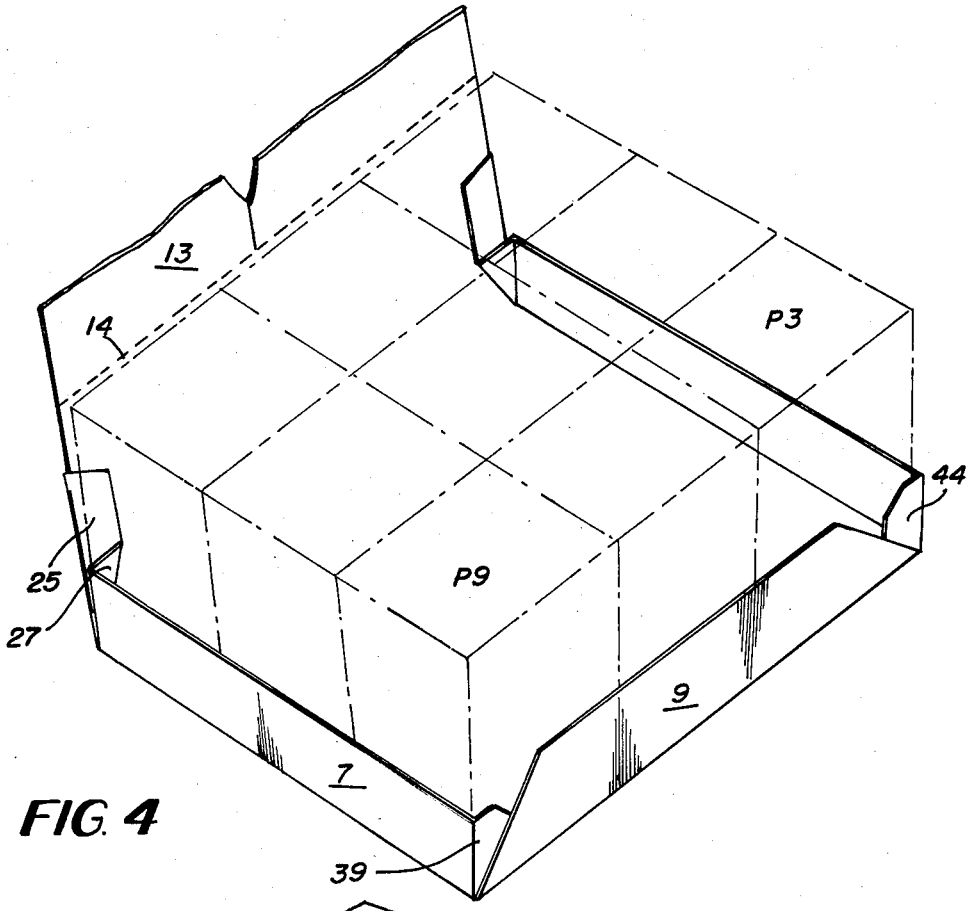
FIG. 4 represents a subsequent folding operation employed in the formation of the package.
Figure 5:
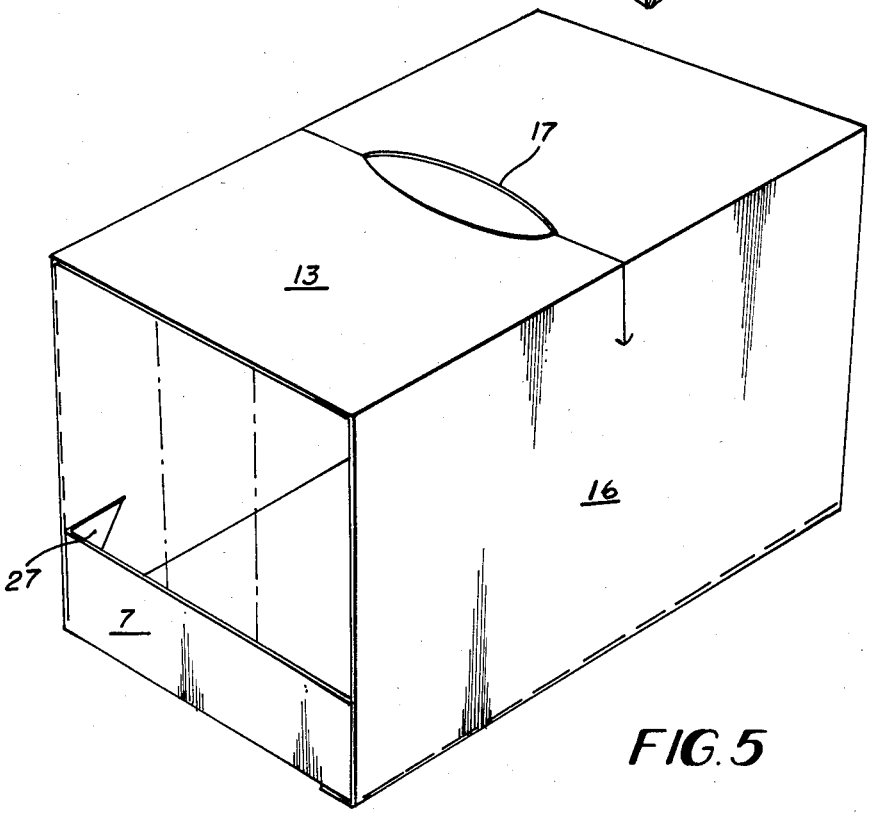
FIG. 5 shows a perspective view of a completed package but with the primary packages shown in phantom lines for clarity.

Formation of the package through the steps represented in FIGS. 2, 3, and 4 results in the setting up of end panels 5 and 7. Thereafter top wall 13 is folded along the fold line 14 into a position overlying the primary packages and the side wall 16 is folded downwardly along fold line 15. The locking tabs 22, 23 and 24 along with the locking panel 20 are manipulated underneath the bottom wall 1 and the locking tabs 22, 23 and 24 are inserted by known means into the corresponding locking apertures 2, 3 and 4 and the package is then complete as shown in FIG. 5.

From the description above, it is apparent that this invention provides a carton which may be nested as described and which thus effects substantial economy in the use of material. Furthermore, the package is completed without the use of glue and is arranged to cover the uniform product code which normally is disposed in the lower portion of the side wall of primary packages such as P1–P9 so that incorrect pricing is avoided. The end panels retain the primary packages against dislodgement through the ends of the secondary package and may afford advertising space and the result is an attractive finished product as shown in FIG. 5 which does not require substantial material or the manipulation of preselected primary packages as contemplated in connection with the apparatus of U.S. Pat. No. 4,545,476.

I claim:

1. A carton for packaging a plurality of articles comprising a bottom wall having opposite side edges and opposite end edges and having at least one locking aperture therein, a generally rectangular end panel having opposite end edges and opposite side edges and foldably joined to each end of said bottom wall along a side edge thereof, a side panel foldably joined to one side edge of said bottom wall, a first side wall having bottom, top and end edges and foldably joined along its bottom edge to the other side edge of said bottom wall, a top wall having opposite side edges foldably joined along one side edge to the top edge of said first side wall, a second side wall having top and bottom edges foldably joined along its top edge to the other side edge of said top wall, a locking panel foldably joined to said second side wall along the bottom edge thereof and having at least one locking tab arranged for insertion into said locking aperture, a tucker flap foldably joined to each end edge of said first side wall and disposed in flat face contacting relation thereto, each of said tucker flaps having a free end and an end adjacent said end panels respectively, a tucker panel foldably joined to one end edge of each of said end panels and to the end of each tucker flap which is adjacent each of said end panels along a diagonal fold line and being disposed in flat face contacting relation to said tucker flap, a tucker panel having a side edge foldably joined to the opposite end edge of each of said end panels and having an end edge normal to said side edge, and a tucker web foldably joined to each end edge of said side panel along a diagonal fold line and to said end edge of the adjacent tucker panel, said tucker webs being interposed between said side panel and the associated tucker panel and being in flat face contacting relation therewith, and a slit formed in each of said tucker flaps in normal relation to the edge thereof remote from the fold line between each such tucker flap and said first side wall.

2. A carton according to claim 1 wherein a triangular shaped cutaway area is interposed between an extension of the fold line connecting ends of each of said tucker flaps and the associated tucker panels and an extension of the fold line between said first side wall and each of said tucker flaps.

3. A blank for a carton for packaging a plurality of articles said blank comprising a bottom wall having opposite side edges and opposite end edges and at least one locking aperture therein, a generally rectangular end panel having opposite side edges and opposite end edges foldably joined to each end of said bottom wall and arranged with its end edges aligned with the side edges of said bottom wall, a side panel foldably joined to one side edge of said bottom wall, a first side wall having top, bottom and end edges and foldably joined along its bottom edge to the other side edge of said bottom wall, a top wall having opposite side edges and opposite end edges and foldably joined along one side edge to the top edge of said first side wall, a second side wall having top, bottom and end edges and foldably joined along its top edge to the other side edge of said top wall, a locking flap foldably joined to said second side wall along the bottom edge thereof and having at least one locking tab, a tucker flap foldably joined to each end edge of said first side wall, each of said tucker flaps having a free end and an end adjacent said end panels respectively, a tucker panel foldably joined to one end edge of each of said end panels and to the end of each tucker flap which is adjacent each of said end panels along a diagonal fold line, a tucker panel having a side edge and foldably joined to the opposite end edge of each of said end panels and having an end edge normal to said side edge, and a tucker web foldably joined to each end edge of said side panel along a diagonal fold line and to said end edge of the adjacent tucker panel, each of said tucker webs being foldably joined to its associated tucker panel along a fold line which is aligned with the fold line between the associated end panel and the adjacent end edge of said bottom wall.

4. A blank according to claim 3 which is adapted for nesting alongside an adjacent identical blank for die cutting from a sheet of material wherein a tucker flap, a tucker panel and an end panel along one side of each blank are disposed alongside the end edges of the top wall and the second side wall of the other blank.

* * * * *